US005125818A

United States Patent [19]

Yeh

[11] Patent Number: 5,125,818

[45] Date of Patent: Jun. 30, 1992

[54] SPINNERETTE FOR PRODUCING BI-COMPONENT TRILOBAL FILAMENTS

[75] Inventor: Ling Yeh, Anderson, S.C.

[73] Assignee: BASF Corporation, Parsippany, N.J.

[21] Appl. No.: 650,583

[22] Filed: Feb. 5, 1991

[51] Int. Cl.[5] ..... D01D 5/34

[52] U.S. Cl. ..... 425/131.5; 264/177.13; 425/461; 428/398

[58] Field of Search ..... 264/171, 177.13; 425/461, 464, 130, 131.5; 428/398, 397

[56] References Cited

U.S. PATENT DOCUMENTS

| | | | |
|---|---|---|---|
| 3,188,689 | 6/1965 | Breen | 425/461 |
| 3,357,048 | 12/1967 | Cobb, Jr. | 425/464 |
| 3,405,424 | 10/1968 | Imobersteg et al. | 425/461 |
| 3,493,459 | 3/1970 | McIntosh et al. | 425/464 |
| 3,528,128 | 9/1970 | Murakami et al. | 425/464 |
| 3,555,600 | 1/1971 | Moore | 425/464 |
| 3,568,249 | 3/1971 | Matsui | 425/131.5 |
| 3,814,561 | 6/1974 | Matsui et al. | 264/171 |
| 3,924,988 | 12/1975 | Hodge | 425/461 |
| 4,357,290 | 11/1982 | Yu | 264/171 |
| 4,408,977 | 10/1983 | Phillips | 425/464 |
| 4,648,830 | 3/1987 | Peterson et al. | 425/464 |
| 4,743,189 | 5/1988 | Samuelson | 425/131.5 |
| 4,836,763 | 6/1989 | Broaddus | 425/131.5 |
| 4,941,812 | 7/1990 | Samelson | 425/133.1 |

FOREIGN PATENT DOCUMENTS

| | | | |
|---|---|---|---|
| 45-15804 | 6/1970 | Japan | 264/171 |
| 48-33415 | 10/1973 | Japan | 264/171 |
| 48-33416 | 10/1973 | Japan | 264/171 |
| 54-34414 | 3/1979 | Japan | 264/171 |
| 54-125717 | 9/1979 | Japan | 264/171 |
| 55-142710 | 11/1980 | Japan | 264/177.13 |
| 57-47937 | 3/1982 | Japan | 264/171 |

OTHER PUBLICATIONS

Kasen Nozzle Mfg. Co., Ltd. Catalog, "Chart of Irregular Shaped Holes", pp. 1-2, Nov. 20, 1977.

*Primary Examiner*—Jay H. Woo
*Assistant Examiner*—William J. Matney, Jr.

[57] ABSTRACT

Capillary groups for a spinnerette include sheath and core openings to produce a spun bi-component fiber having a trilobal or triangular profile. A triangular or trilobal configured outer sheath arrangement surrounds a trilobal cross-section core which is alternatively oriented with its lobes toward the sheath tips or rotated 60 degrees thereto. Different sheath arrangements are also disclosed for producing bi-component sheath/core trilobal fibers with and without voids.

15 Claims, 2 Drawing Sheets

SPINNERETTE FOR PRODUCING BI-COMPONENT TRILOBAL FILAMENTS

BACKGROUND OF THE INVENTION

This invention relates to trilobal cross-section fibers or filaments, for use as carpet yarn, for example, and more particularly to a spinnerette for their manufacture. The invention further relates to bi-component fibers and their manufacture.

Many current upholstery and carpet products are made of filaments or fibers spun from polymers. Typically, a polymer stream is passed through capillaries, or orifices, in a spinnerette to achieve a specific profile or cross-section. The profiles of these spun synthetic fibers are typically designed to have high stability and bending strength, and to part a high gloss and bulk to the finished product. Most current spun polymer filaments are composed of conventional synthetic polymers, such as nylon, polyester, or polyolefin polymers. In many instances, nylon 6-6 and its copolymers are used to produce yarn.

It has been found that bi-component filaments permit the manufacture of a carpet filament that combines the beneficial properties of two different polymers. In addition, it has also been found that filaments manufactured in a sheath/core relationship frequently have improved flexural rigidity and bending resistance. In the past, bi-component trilobal filaments have been produced by combining polymer streams in a manner similar to that disclosed in the patent to Matsui, U.S. Pat. No. 3,568,249. As disclosed in that reference, a first polymer stream passes through a trilobal shaped capillary and subsequently combines with a second polymer stream in which the first and second polymer streams pass jointly through a second trilobal shaped spinnerette capillary. Prior methods such as disclosed in the Matsui patent rely heavily upon the viscosity of the inner polymer stream to maintain a proper cross-sectional relationship when combining with the outer polymer material passing through the last spinnerette capillary. Moreover, procedures of this type require multiple spinnerettes. Control of temperature and pressure of the two polymer streams is also critical in these prior procedures.

The patent to Samuelson, U.S. Pat. No. 4,743,189, discloses a bi-component filament which includes a trilobal core within a circular sheath. The core in this device filament is free (i.e., not fused) from the inner surface of the circular outer sheath. While the Samuelson reference discloses a trilobal core, the overall profile of the filament is circular, thereby losing the beneficial effects of a trilobal or triangular profile shape.

On the other hand, the patent to Peterson et al., U.S. Pat. No. 4,648,830, discloses a spinnerette for producing a hollow trilobal cross-section filament. This reference, however, does not disclose a bi-component filament or spinnerette for producing such a filament.

There remains a need for a spinnerette for producing a bi-component filament having a trilobal or triangular profile in order to obtain the benefits associated with these profile shapes and bi-component material properties.

SUMMARY OF THE INVENTION

A spinnerette plate for melt spinning molten polymers is provided with a capillary group comprising a trilobal core opening having three connected lobes radiating outwardly at approximately 120° intervals, and sheath arrangement having at least three elongated openings arranged in end-to-end relation surrounding the core opening in a generally triangular pattern. In one embodiment, the sheath arrangement includes three V-shaped openings, each having a bend portion between the ends of the openings. The ends of adjacent V-shaped openings is separated by a gap. The sheath arrangement is oriented with respect to the core opening such that the bend portion of one each of the V-shaped openings is aligned with one each of the lobes of the core opening.

This spinnerette plate can be used in the spinning of bi-component fibers for use in producing carpet. A first polymer stream extruded through the trilobal core opening and a second polymer stream passing through the sheath arrangement coalesce into a finished trilobal fiber with the sheath and core in intimate contact.

In another embodiment, the sheath arrangement is oriented with respect to the core opening such that the gap between adjacent V-shaped openings is aligned with one each of the lobes of the core opening.

Fibers spun with the capillary groups of these embodiments will be trilobal in profile, and may have voids between the sheath and core polymers.

In another embodiment and its variant, the capillary group includes a sheath arrangement having three linear openings and a trilobal core situated in either of the two orientations described above with respect to the linear openings. Fibers spun from these capillary groups will have a triangular profile, with and without voids.

In yet another embodiment, the sheath arrangement includes at least six linear openings, the ends of adjacent openings being separated by a gap. The sheath arrangement is oriented relative to the core opening with one each of the lobes of the trilobal core opening extending through alternating ones of the gaps.

It is one object of the invention to provide a capillary group for a spinnerette that provides a core-sheath arrangement for spinning bi-component fibers. Another object is to provide a spinnerette capillary group to produce spun polymer fibers having a trilobal core, as well as spun fibers having a trilobal or triangular profile.

Other objects and benefits of the invention will become apparent from the following written description and accompanying figures.

DESCRIPTION OF THE PREFERRED EMBODIMENTS

Figure 1A:
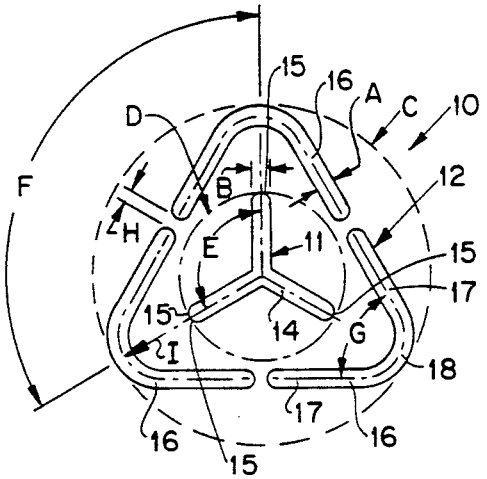
FIG. 1A is a plan view of a spinnerette capillary viewed from the lower surface of the spinnerette.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

One embodiment of the spinnerette capillary design of the present invention is shown in FIG. 1A. The capillary group 10 includes a trilobal core opening 11 and an arrangement of openings defining a generally triangular-shaped sheath 12. The trilobal core opening 11 includes three connected lobes 14 radiating outwardly in a "Y" configuration. The sheath 12 is formed from three elongated openings 16 surrounding the core 11 in a triangular pattern. Each of the openings 16 includes a pair of leg portions 17 joined by a curved bend portion 18 which subtends an acute angle. In the embodiment of FIG. 1A, each of the bend portions 18 can alternatively be referred to as a tip of the sheath arrangement.

The spinnerette capillary group 10 is defined by several dimensions A-I denoted in FIG. 1A. The dimension A corresponds to the width of the openings 16 forming the outer sheath arrangement 12. This width A is between 0.05–0.20 mm. The width of the lobes 14 of the trilobal core opening 11, corresponding to dimension B, is also between 0.05–0.20 mm. The outer diameter C of an imaginary circle encircling the sheath arrangement 12 is between 1–4 mm. The inside diameter D of another imaginary circle encircling the tips 15 of the lobes 14 is between 0.5–2.0 mm. The lobes 14 are situated at an angle E of 120 degrees, as measured between the longitudinal axes of each of the leg portions 17, which is the same angle F of separation between bend portions 18, or tips, of the sheath arrangement 12. Each bend portion 18 subtends an angle G of 60° and has a tip radius I of 0.05–1.0 mm. The ends of the leg portions 17 of adjacent elongated openings 16 is separated by a gap having a width H of between 0.05–0.20 mm.

Any filament count yarn can be manufactured from a spinnerette having a number of capillary groups 10 according to the embodiment of FIG. 1A. Polymers can be extruded under conventional spinning conditions through the capillary groups 10 into a quench stack and subsequently taken up onto a package where it is further processed into typical carpet yarn. This carpet yarn can then be tufted into a carpet using conventional tufting methods. A bi-component fiber can be produced by passing a first polymer through the core opening 11 and a second polymer through the sheath arrangement 12. It is understood, of course, that the first and second polymers can be selected to enhance the properties of the resulting carpet fiber or filament.

In the embodiment of FIG. 1A, the core lobes 14 are aligned with or oriented toward the sheath tips or bend portions 18. Thus, when polymer streams are extruded through the capillary group 10, the first polymer passing through the core opening 11 expands and the second polymer extruded through the sheath arrangement 12 contracts about the core polymer so that a trilobal profile is formed between the core and sheath. The gap dimension H between the ends of adjacent elongated openings 16 is filled with the second polymer to form a continuous sheath surrounding the trilobal core.

Figure 1B:
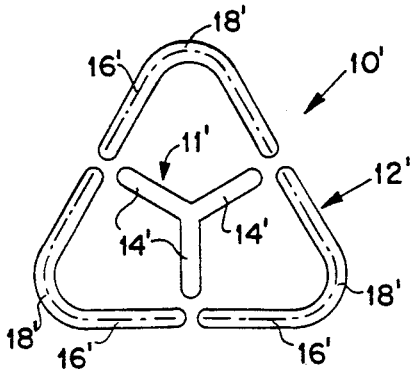
FIG. 1B is a plan view of a spinnerette capillary variation of the embodiment of FIG. 1A in which the trilobal core component is rotated by 60 degrees relative to the core position in FIG. 1A.

In FIG. 1B, a variation of the capillary group of FIG. 1A is shown in which a group 10' includes an outer sheath arrangement 12' identical to the sheath arrangement 12 of the prior embodiment. The trilobal core opening 11' has the same lobe dimensions as the previous embodiment, although the lobes 14' are rotated 60 degrees relative to the orientation of the trilobal core 11 of the previous embodiment. That is, the lobes 14' are oriented 60 degrees away from the sheath bend portions or tips 18' and toward the middle of a side of the sheath.

In these preferred embodiments, the various capillary group dimensions A-I are configured to produce a modification ratio of between 1.5–3.0 in the finished product fiber, and an arm tip angle of between 15–60 degrees, corresponding to dimension G. In addition, the trilobal core 11 will typically comprise more then 50% of the total cross-sectional area of the total filament profile.

A filament produced by spinning through the capillary groups 10 and 10' may include a number of voids between the trilobal core and the outer sheath as the core and sheath expand and shrink, respectively.

Figure 2A:
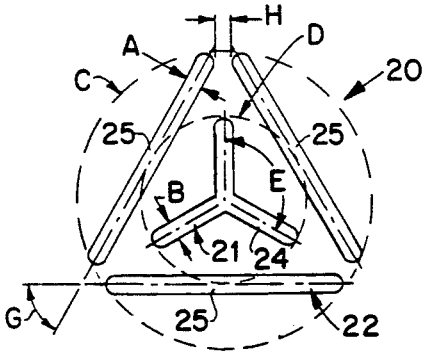
FIG. 2A is a plan view of an alternative embodiment of the present invention.

FIG. 2A illustrates a second embodiment in which a capillary group 20 includes a trilobal core opening 21 and a segmented triangular sheath arrangement 22. The core opening 21 includes three "Y" configured connected lobes 24. The sheath 22 includes three linear openings 25 arranged in a triangular configuration. Each of the capillary dimensions A–H are the same as the dimensions of the embodiment of FIG. 1A. A filament spun from this capillary group 20 will have a similar profile as the filament spun from the capillary group 10. Depending on the viscosities of the two polymer streams extruded through capillary group 20, the ends of core lobes 24 may be visible at the outer surface of the resulting fiber because the polymer passing through the linear openings 25 will contract against the trilobal core leaving the lobes 24 protruding through the gap H.

Figure 2B:
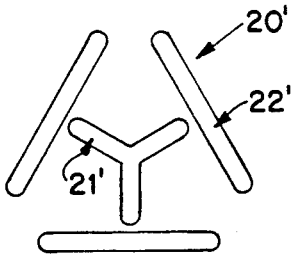
FIG. 2B is a plan view of a spinnerette capillary variation of the embodiment of FIG. 2A in which the trilobal core component is rotated by 60 degrees relative to the core position in FIG. 2A.

FIG. 2B shows an alternative capillary group 20' which is configured similarly to the capillary group 20, although the trilobal core opening 21' is rotated by 60 degrees relative to the trilobal orientation in FIG. 2A. As with the alternative version of FIG. 1B, the filament spun from this capillary group 20' could include a number of voids between the trilobal core 21' and the sheath arrangement 22'.

Figure 3A:
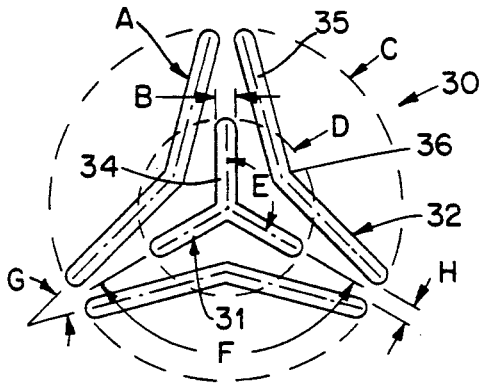
FIG. 3A is a plan view of an alternative embodiment of the present invention.
Figure 3B:
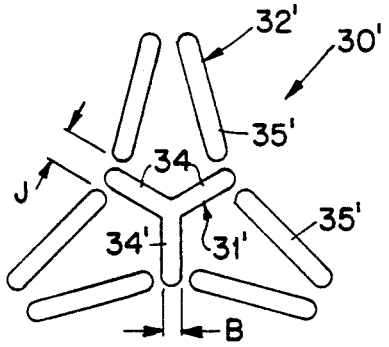
FIG. 3B is a plan view of a spinnerette capillary variation of the embodiment of FIG. 3A in which the trilobal core component is rotated by 60 degrees relative to the core position in FIG. 3A.

FIGS. 3A–3B illustrate yet another embodiment and its variant of the spinnerette configuration of the present invention. In this embodiment, a capillary group 30 includes a trilobal core opening 31 and an outer sheath arrangement 32. The trilobal core opening 31 is identical to the core openings 11 and 21 of the previous embodiments. The sheath arrangement 32 is substantially similar to the sheath arrangement 22 of the FIG. 2A embodiment in that the sheath includes three elongated openings 35 generally arranged in a triangular configuration. However, each of the elongated openings 35 in the capillary group 30 includes a bend portion 36 at the mid-section of the opening 35, in which the opening 35 partially conforms to the trilobal configuration of the core opening 31. In this capillary group 30, the outer sheath arrangement 32 more closely corresponds to the trilobal core opening 31. With this configuration, polymer streams having substantially different viscosities can be used and still obtain the same trilobal profile as a filament spun with the prior capillary group embodiments. The dimensions A–H are similar to the profile group dimensions of the previous embodiments.

In a variation of the capillary group 30, a capillary group 30', shown in FIG. 3B, includes a trilobal core opening 31' rotated 60° relative to the core opening 31 shown in FIG. 3A. The capillary group 30' also includes an outer sheath arrangement 32' which is composed of six linear openings 35' oriented in a generally trilobal configuration, with a gap separating adjacent openings 35'. In this variation, alternating gaps between the ends of adjacent pairs of linear openings 35' are wide enough to accept the ends of core lobes 34' extend therethrough. This gap dimension J must be at least equal to the width dimension B of the lobe openings 34', but is preferably 0.05 mm greater than the dimension B. As with the previous alternative versions of FIGS. 1B and 2B, the capillary group 30' of FIG. 3B could produce a spun filament having a number of voids between the core 31' and the sheath 32'.

Figure 4A:
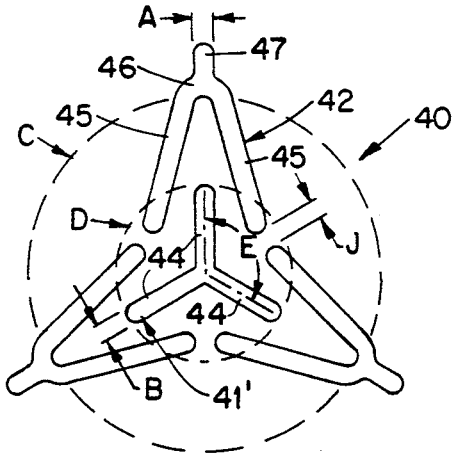
FIG. 4A is a plan view of an still another alternative embodiment of the present invention.
Figure 4B:
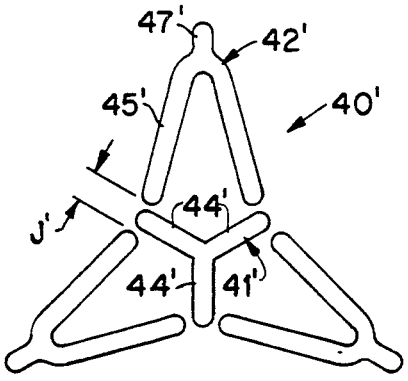
FIG. 4B is a plan view of a spinnerette capillary variation of the embodiment of FIG. 4A in which the trilobal core component is rotated by 60 degrees relative to the core position in FIG. 4A.

FIGS. 4A–4B depict still another embodiment and its variant of the spinnerette of the present invention. In this embodiment, a capillary group 40 includes a trilobal core opening 41 which is identical in shape and dimension to the previously described cores. The sheath arrangement 42 is derived to a large degree from the sheath 32' of FIG. 3B in that it is comprised of six linear openings 45. In this embodiment, however, adjacent pairs of linear openings 45 are connected at a joint 46 at the vertex of the openings, forming a bend between the linear openings similar to the bend 18 of the embodiment of FIG. 1A. A finger 47 projects radially from each joint 46 so that each section of the sheath arrangement has the appearance of a wishbone.

At the ends of the linear openings 45 opposite the joint 46, the ends of adjacent pairs are separated by a gap J. In the present embodiment, the dimension of the gap J is between 0.05–0.20 mm. The remaining dimensions of the capillary group 40 are similar to the labeled dimensions from the prior embodiments. In the preferred embodiment, the fingers 47 project 0.10–0.40 mm. from the joints 46.

With respect to the alternate version shown in FIG. 4B, the capillary group 40' includes a trilobal core 41' rotated by 60° from its prior counterpart. The outer sheath arrangement 42' is substantially similar to the arrangement 42 of FIG. 4A. The gap J' shown in FIG. 4B preferably has a dimension at least equal to the width dimension of the core lobe openings 44' to accept the ends of the core lobes therethrough. The fingers 47 and 47' of these latter two embodiments provide an increase in the modification ratio of the spun fiber product.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. In a spinnerette plate for melt spinning molten polymers, a capillary group comprising:

a trilobal core opening having three connected lobes radiating outwardly at approximately 120° intervals; and a sheath arrangement having at least three elongated openings arranged in end-to-end relation surrounding said core opening in a generally triangular pattern.

2. The capillary group according to claim 1, wherein:

said sheath arrangement includes three V-shaped openings, each of said V-shaped openings having a bend portion between the ends of the openings, the ends of adjacent V-shaped openings being separated by a gap.

3. The capillary group according to claim 2, wherein:

said sheath arrangement is oriented with respect to said core opening such that each of said gap between adjacent V-shaped openings is aligned with one each of said lobes of said core opening.

4. The capillary group according to claim 3, wherein said bend portion of each of said V-shaped openings subtends an acute angle.

5. The capillary group according to claim 4, wherein said bend portion of each of said V-shaped openings includes a radially outwardly projecting finger.

6. The capillary group according to claim 3, wherein said bend portion of each of said V-shaped openings subtends an obtuse angle.

7. The capillary group according to claim 2, wherein:

said sheath arrangement is oriented with respect to said core opening such that said bend portion of one each of said V-shaped openings is aligned with one each of said lobes of said core opening.

8. The capillary group according to claim 7, wherein said bend portion of each of said V-shaped openings subtends an acute angle.

9. The capillary group according to claim 8, wherein said bend portion of each of said V-shaped openings includes a radially outwardly projecting finger.

10. The capillary group according to claim 2, wherein said bend portion of each of said V-shaped openings includes a radially outwardly projecting finger.

11. The capillary group according to claim 1, wherein:

said sheath arrangement includes three linear openings, the ends of adjacent linear openings being separated by a gap.

12. The capillary group according to claim 11, wherein:

said sheath arrangement is oriented with respect to said core opening such that each of said gap between adjacent linear openings is aligned with one each of said lobes of said core opening.

13. The capillary group according to claim 11, wherein:

adjacent ones of said lobes subtends a lobe angle; and said sheath arrangement is oriented with respect to said core opening such that each said gap between adjacent linear openings is aligned with one each of said lobe angles.

14. The capillary group according to claim 1, wherein:

said sheath arrangement includes at least six linear openings, the ends of adjacent openings being separated by a gap.

15. The capillary group according to claim 14, wherein:

said sheath arrangement is oriented relative to said core opening with one each of said lobes of said core opening extending through alternating ones of said gaps.

* * * * *